US005555858A

United States Patent [19]

Katoh

[11] Patent Number: 5,555,858

[45] Date of Patent: Sep. 17, 1996

[54] ENGINE MANAGEMENT SYSTEM

[75] Inventor: Masahiko Katoh, Hamamatsu, Japan

[73] Assignee: Sanshin Kogyo Kabushiki Kaisha, Hamamatsu, Japan

[21] Appl. No.: 439,489

[22] Filed: May 11, 1995

[30] Foreign Application Priority Data

May 11, 1991 [JP] Japan ..... 6-120811

[51] Int. Cl.[6] ..... B63H 21/26

[52] U.S. Cl. ..... 123/73 SC; 123/572; 123/73 AD

[58] Field of Search ..... 123/73 AD, 572, 123/573, 574, 735 C

[56] References Cited

U.S. PATENT DOCUMENTS 4,794,888 1/1989 Lang ..... 123/73 SC
4,794,889 1/1989 Hensel ..... 123/73 SC
4,967,700 11/1990 Torigai ..... 123/73 AD
5,052,355 10/1991 Ito et al. ..... 123/73 AD
5,476,073 12/1995 Betts ..... 123/73 AD

*Primary Examiner*—Marguerite McMahon
*Attorney, Agent, or Firm*—Knobbe, Martens, Olson & Bear

[57] ABSTRACT

A number of embodiments of drain-control systems for two-cycle crankcase compression internal combustion engines wherein collected lubricant and condensed fuel may be pumped out of a low spot in the engine when certain engine conditions exist. The pumped liquid is delivered back either to the engine through its induction system or exhaust system for further burning or is mixed with the fuel that is delivered to the engine. Adjustments are made in the fuel-air ratio supplied by the charge-forming system when the drains are being pumped so as to avoid uneven running.

78 Claims, 14 Drawing Sheets

ENGINE MANAGEMENT SYSTEM

BACKGROUND OF THE INVENTION

This invention relates to an engine management system and more particularly to a system for pumping drains from a two-cycle crankcase compression engine under some running conditions and returning them to the combustion chamber and associated controls therefor.

It is well known that with two-cycle crankcase compression engines, there is a tendency for fuel and/or lubricant to condense in the crankcase chamber or some other low portion of the engine. This accumulated liquid, at times, again becomes vaporized and mixes with the fuel that is delivered to the combustion chamber. This fluctuating amount of return of condensed liquids can give rise to rough engine performance. This problem is particularly acute in conjunction when running under low speeds and low load conditions.

Various arrangements have been proposed for draining the liquids that so accumulate in an engine and returning them to the engine induction system for burning and discharge of the burnt products to the atmosphere. Many of these systems operate on a gravity principle and thus the actual control of the timing and the volume of condensed liquid that is returned to the engine through its induction system cannot be controlled.

It is, therefore, a principal object of this invention to provide an improved arrangement for pumping accumulated liquids from a low part of a two-cycle crankcase compression engine in a controlled manner and in such a manner that the pumped liquid will not disrupt the engine running.

It is a further object of this invention to provide an improved control system for controlling the removal of condensed liquids in the engine.

Obviously from the foregoing description it should be apparent that the return of the condensed liquids to the induction system will alter the fuel/air ratio. Devices of the type previously proposed have not been able to accommodate and adjust the air/fuel ratio in response to the return of these liquids to the engine through its induction system.

This problem can be best understood by reference to FIGS. 1 and 2, which are graphical views of watercraft velocity and fuel/air ratio with respect to time in a watercraft powered by a two-cycle crankcase compression internal combustion engine upon acceleration. The solid line curve shows an ideal situation when no drains are permitted to re-enter the engine through its induction system while the dotted line curves show the actual conditions when drain recirculation is present. As may be seen when accelerating from rest to a trowling speed, the velocity of the watercraft increases much faster and reaches the optimum speed A much quicker when drains are not present and the fuel/air ratio is maintained as desired. However, when drains are mixed with the fuel air charge, then the mixture becomes overrich and performance deteriorates.

It is, therefore, a still further object of this invention to provide an improved engine management system and control arrangement wherein the return of condensed liquids to the engine is accompanied by an appropriate adjustment in the amount of fuel supplied to the engine.

It has also been found that by changing the amount of fuel supplied to the engine immediately upon return of the liquids to the induction system and the discontinuance of the leaning of the mixture upon stopping of the return, do not give rise to smooth engine performance. That is, in order to achieve smooth engine performance it may be desirable to actually lean the fuel-air ratio before the liquids are returned and to discontinue the leaning at some time period after the return of liquids has been concluded.

It is, therefore, a still further object of this invention to provide an improved drain removal system for a two-cycle crankcase compression engine incorporating an arrangement for controlling the fuel-air ratio in response to the return of the liquids to the engine through its induction system.

It is a further object of this invention to provide an improved arrangement for controlling the fuel-air ratio, both during the time when condensed liquids are returned to the engine, but also preceding that time and immediately after the return is discontinued so as to provide smooth running.

SUMMARY OF THE INVENTION

A method and apparatus for practicing this invention is adapted to be embodied in a two-cycle crankcase compression internal combustion engine having an induction system for delivering at least an air charge to a combustion chamber of the engine. The engine has an area where fuel and lubricant may accumulate during engine operation.

In accordance with an apparatus for practicing this invention, pumping means are provided for pumping accumulated liquid from the area. Means also sense a condition, and control means operate the pumping means only when the condition is sensed.

In accordance with a method for practicing the invention, an engine condition is sensed, and when the engine condition is sensed, the accumulated liquids in the area are pumped from the area.

Other features of the invention are adapted to be embodied in a two-cycle crankcase compression internal combustion engine and a method for operating such an engine. The engine has an induction and charge-forming system for delivering a fuel-air charge to a combustion chamber of the engine for engine operation. The engine also has an area where fuel and lubricant may collect as a liquid.

In accordance with an apparatus for practicing the invention, pumping means are provided for pumping the accumulated liquid from the area to the induction and charge-forming system. Means are provided for altering the fuel-air ratio supplied by the charge-forming system in response to the operation of the pumping means.

In accordance with a method for performing the invention in accordance with the engine described in the second preceding paragraph, liquid accumulated in the area is pumped from the area and delivered to the induction and charge-forming system. The fuel-air ratio supplied by the charge-forming system is altered in response to the operation of the pumping means, so as to maintain even running.

DETAILED DESCRIPTION OF THE PREFERRED EMBODIMENTS OF THE INVENTION

Figure 3:
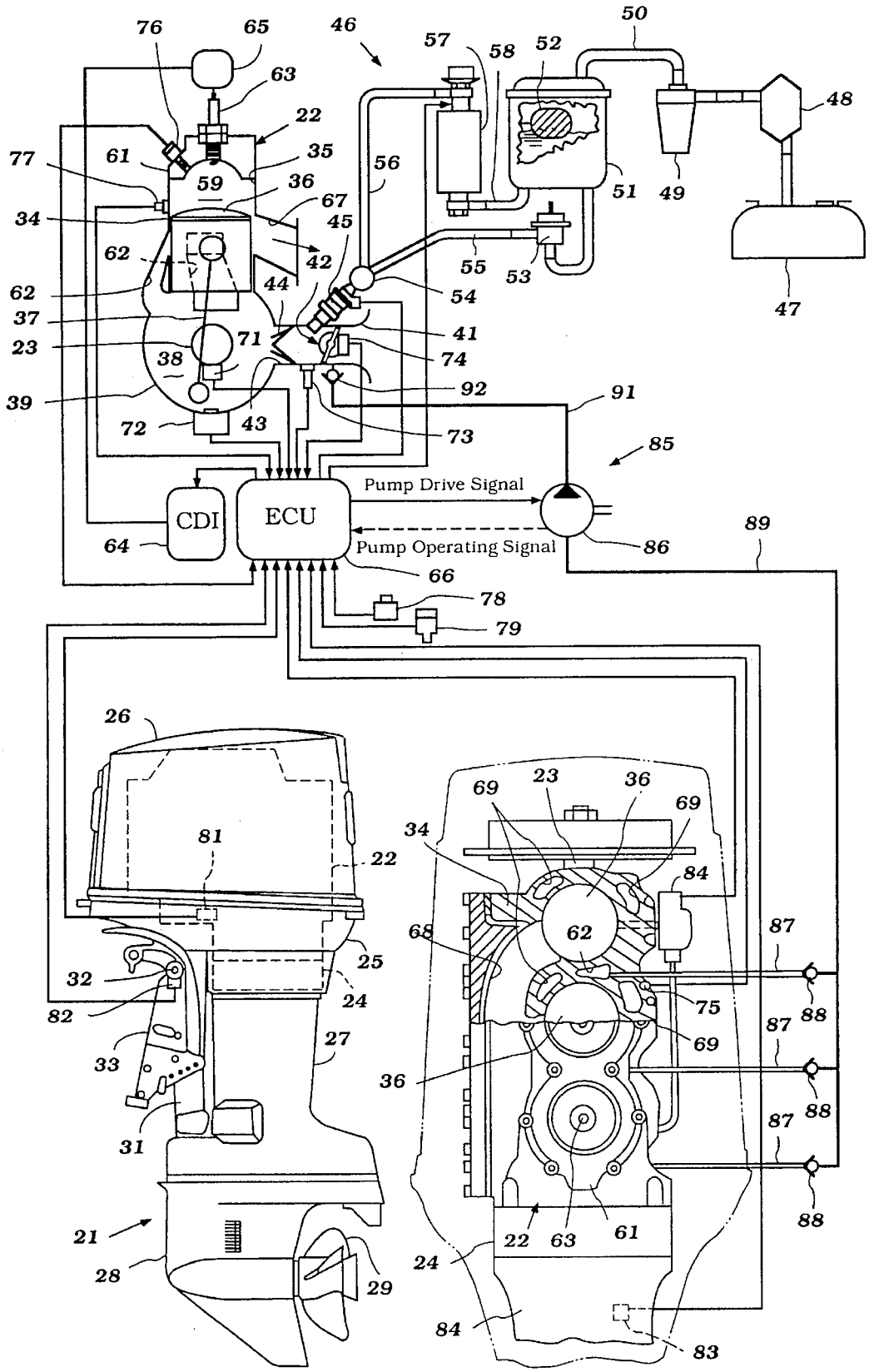
FIG. 3 is a partially schematic view showing an outboard motor constructed in accordance with an embodiment of the invention in side elevation, a portion of the power head enlarged and with parts broken away and shown in section, and a schematic view of one cylinder of the engine and the fuel supply system and pumping arrangement for the drained liquids partially in schematic fashion.

Referring now in detail to the drawings, and initially to FIG. 3, an outboard motor is shown in the lower left-hand side of this figure in side elevation and is indicated generally by the reference numeral 21. The invention is shown in conjunction with an outboard motor because the invention has particular utility in conjunction with two-cycle cycle crankcase compression engines. Such engines are normally used as the propulsion device for outboard motors.

In addition to this reason, the engine in an outboard motor is normally operated so that the crankshaft or engine output shaft rotates about a vertically extending axis. This disposition of the crankshaft tends to aggravate the drain problems that exist with two-cycle crankcase compression engines. Thus, although the invention is described in conjunction with an outboard motor, it should be readily apparent to those skilled in the art how the invention can be utilized with other engine applications, and particularly those involving two-cycle crankcase compression engines.

For these reasons, the full details of the outboard motor 21 will not be described and have not been illustrated. Those skilled in the art can readily understand how the invention can be utilized with any known type of outboard motor.

The outboard motor 21 includes a power head that is comprised of a powering internal combustion engine, indicated generally by the reference numeral 22. The engine 22 is shown in the lower left-hand portion of FIG. 3 and in the lower right-hand side of FIG. 3, with a portion broken away, and in a schematic cross-sectional view through a single cylinder in the upper view of this figure. The construction of the engine 22 will be described later, but it should be noted that the engine 22 is mounted in the power head so that its crankshaft, indicated by the reference numeral 23, rotates about a vertically extending axis. The engine 22 is mounted on a guide plate 24 provided at the lower end of the power head and the upper end of a drive shaft housing, to be described.

Finally, the power head is completed by a protective cowling comprised of a lower tray portion 25 and a detachable upper main cowling portion 26.

The engine crankshaft 23 is coupled to a drive shaft (not shown) that depends into and is rotatably journalled within the aforenoted drive shaft housing which is indicated by the reference numeral 27. This drive shaft then continues on to drive a forward/neutral/reverse transmission, which is not shown but which is contained within a lower unit 28. This transmission provides final drive to a propeller 29 in any known manner for propelling an associated watercraft.

A steering shaft (not shown) is affixed to the drive shaft housing 27. This steering shaft is journalled for steering movement within a swivel bracket 31 for steering of the outboard motor 21 and the associated watercraft in a well-known manner.

The swivel bracket 31 is, in turn, pivotally connected by a pivot pin 32 to a clamping bracket 33. The clamping bracket 33 is adapted to be detachably affixed to the transom of an associated watercraft. The pivotal movement about the pivot pin 32 accommodates trim and tilt-up operation of the outboard motor 21, as is well known in this art.

Continuing to refer to FIG. 3, and now primarily to the lower right-hand side view and the upper view, the engine 22 is depicted as being of the two-cycle crankcase compression type and, in the specific illustrated embodiment, is of a three-cylinder in-line configuration. Although this particular cylinder configuration is illustrated, it will be apparent to those skilled in the art how the invention may be employed with engines having other numbers of cylinders and other cylinder orientations. In fact, certain facets of the invention may also be employed with rotary-type engines.

The engine 22 includes a cylinder block 34 in which three cylinder bores 35 are formed. Pistons 36 reciprocate in these cylinder bores 35 and are connected by means of connecting rods 37 to the crankshaft 23. The crankshaft 23 is, in turn, journalled for rotation within a crankcase chamber 38 in a suitable manner. The crankcase chamber 38 is formed by the cylinder block 34 and a crankcase member 39 that is affixed to it in any known manner.

As is typical with two-cycle crankcase compression engine practice, the crankcase chambers 38 associated with each of the cylinder bores 35 are sealed relative to each other in an appropriate manner. A fuel-air charge is delivered to each of the crankcase chambers 28 by an induction system which is comprised of an atmospheric air inlet 41 which draws atmospheric air from within the protective cowling. This air is admitted to the protective cowling in any suitable manner.

A throttle valve assembly 42 is positioned in an intake manifold downstream of the air inlet 41 and is operated in any known manner. Finally, the intake system discharges into intake ports 43 formed in the crankcase member 39. Reed-type check valves 44 are provided in each intake port 43 for permitting the charge to be admitted to the crankcase chambers 38 when the pistons 36 are moving upwardly in the cylinder bore 35. These reed-type check valves 44 close when the piston 36 moves downwardly to compress the charge in the crankcase chambers 38, as is also well known in this art.

Fuel is added to the air charge inducted into the crankcase chambers 38 by a suitable charge former. In the illustrated embodiments, this charge former includes fuel injectors 45, each mounted in a respective branch of the intake manifold downstream of the throttle valve 42. The fuel injectors 45 are preferably of the electronically operated type. That is, they are provided with an electric solenoid that operates an injector valve so as to open and close and deliver high-pressure fuel directed toward the intake port 43.

Fuel is supplied to the fuel injectors 45 under high pressure through a fuel supply system, indicated generally by the reference numeral 46. This fuel supply system 46 includes a fuel tank 47 which is positioned remotely from the outboard motor 21 and preferably within the hull of the watercraft propelled by the outboard motor 21. Fuel is pumped from the fuel tank 47 by means of a fuel pump 48, which may be electrically or otherwise operated. This fuel then passes through a fuel filter 49, which preferably is mounted within the power head of the outboard motor 21. Fuel flows from the fuel filter 49 through a conduit 50 into a fuel vapor separator 51, which includes a float control valve 52 for controlling the level of fuel in the fuel vapor separator 51. Any accumulated vapor will condense, and excess vapor pressure can be relieved through a suitable vent (not shown).

Also mounted, preferably in the power head, is a high-pressure fuel pump 53 which is driven in any known manner as by an electric motor or directly from the engine 22. This fuel pump 53 delivers fuel under high pressure to a fuel rail 54 through a conduit 55. The fuel rail 54 serves each of the injectors 45 associated with the engine.

A return conduit 56 extends from the fuel rail 54 to a pressure regulator 57. The pressure regulator 57 controls the maximum pressure in the fuel rail 54, and that is supplied to the fuel injectors 45. This is done by dumping excess fuel back to the fuel vapor separator 51 through a return line 58. The regulated pressure may be adjusted electrically along with other controls, as will be described.

The fuel-air charge which is formed by the charge-forming and induction system as thus far described is transferred from the crankcase chambers 38 to combustion chambers, indicated generally by the reference numeral 59, of the engine. These combustion chambers 59 are formed by the heads of the pistons 36, the cylinder bores 35, and a cylinder head assembly 61 that is fixed to the cylinder block 34 in any known manner. The charge so formed is transferred to the combustion chamber 59 from the crankcase chambers 38 through one or more scavenge passages 62.

Spark plugs 63 are mounted in the cylinder head 61 and are fired by a capacitor discharge ignition system 64, which is shown schematically. This outputs a signal to a spark coil 65 mounted on each spark plug 63 for firing the spark plug 63 in a known manner.

The capacitor discharge ignition circuit 64 is operated, along with certain other engine controls such as the regulated fuel pressure, by an engine management ECU, shown schematically and identified generally by the reference numeral 66.

When the spark plugs 63 fire, the charge in the combustion chambers 59 will ignite and expand so as to drive the pistons 36 downwardly. The combustion products are then discharged through exhaust ports 67 formed in the cylinder block 34. These exhaust gases then flow through an exhaust manifold, shown partially in the lower right-hand side of FIG. 3 and identified by the reference numeral 68. The exhaust gases then pass downwardly through an opening in the guide plate 24 to an appropriate exhaust system for discharge of the exhaust gases to the atmosphere. Conventionally, the exhaust gases are discharged through a high-speed under-the-water discharge and a low-speed, above-the-water discharge. The systems may be of any type known in the art.

The engine 22 is water cooled, and for this reason, the cylinder block 34 is formed with a cooling jacket 69 to which water is delivered from the body of water in which the watercraft is operating. Normally, this coolant is drawn in through the lower unit 28 by a water pump positioned at the interface between the lower unit 28 and the drive shaft housing 27 and driven by the drive shaft. This coolant also circulates through a cooling jacket formed in the cylinder head 61. After the water has been circulated through the engine cooling jackets, it is dumped back into the body of water in which the watercraft is operating. This is done in any known manner and may involve the mixing of the coolant with the engine exhaust gases to assist in their silencing.

Although not shown in the drawings, the engine 22 is also provided with a lubricating system for lubricating the various moving components of the engine 22. This system may spray fuel into the intake passages in proximity to the fuel injector nozzles 45 and/or may deliver lubricant directly to the sliding surfaces of the engine 22.

It has been noted that the ECU 66 controls the capacitor discharge ignition circuit 64 and the firing of the spark plugs 63. In addition, the ECU controls the fuel injectors 45 so as to control both the beginning and duration of fuel injection and the regulated fuel pressure, as already noted. The ECU 66 may operate on any known strategy for the spark control and fuel injection control 45, although this system is modified in accordance with the invention.

So as to permit engine management, a number of sensors are employed. Some of these sensors are illustrated either schematically or in actual form, and others are not illustrated. It should be apparent to those skilled in the art, however, how the invention can be practiced with a wide variety of control strategies other than or in combination with those which form the invention.

The sensors include a crankshaft position sensor 71 which senses the angular position of the crankshaft 23 and also the speed of its rotation. A crankcase pressure sensor 72 is also provided for sensing the pressure in the individual crankcase chambers 38. Among other things, this crankcase pressure signal may be employed as a means for measuring intake air flow and, accordingly, controlling the amount of fuel injected by the injector 45, as well as its timing.

A temperature sensor 73 may be provided in the intake passage downstream of the throttle valve 42 for sensing the temperature of the intake air. In addition, the position of the throttle valve 42 is sensed by a throttle position sensor 74. Engine temperature is sensed by a coolant temperature sensor 75 that is mounted in an appropriate area in the engine cooling jacket 69. An in-cylinder pressure sensor 76 may be mounted in the cylinder head 61 so as to sense the pressure in the combustion chamber 59. A knock sensor 77 may also be mounted in the cylinder block 34 for sensing the existence of a knocking condition.

Certain ambient conditions also may be sensed, such as atmospheric air pressure by a sensor 78, intake cooling water temperature, as sensed by a sensor 79, this temperature being the temperature of the water that is drawn into the cooling system before it has entered the engine cooling jacket 69.

In accordance with some portions of the control strategy, it may also be desirable to be able to sense the condition of the transmission for driving the propeller 29 or at least when it is shifted into or out of neutral. Thus, a transmission condition sensor 81 is mounted in the power head and cooperates with the shift control mechanism for providing the appropriate indication.

Furthermore, a trim angle sensor 82 is provided for sensing the angular position of the swivel bracket 31 relative to the clamping bracket 33.

Finally, the engine exhaust gas back pressure is sensed by a back pressure sensor 83 that is positioned within an expansion chamber 84 which forms part of the exhaust system for the engine and which is positioned in the drive shaft housing 27.

In addition, an oxygen sensor 84 is provided for sensing the richness or leanness of the fuel-air mixture by determining presence of oxygen in the exhaust gases. This exhaust gas sensor 84 may be of the type described in the copending application of Masahiko Katoh, entitled "Sensor Arrangement for Engine Control System," Ser. No. 08/435,715, filed May 5, 1995 (attorney docket No. SANSH2.941A), assigned to the assignee hereof.

As has been noted, the engine 22 is also provided with a lubrication system that supplies lubricant to the engine for its running. Under some circumstances this lubricant may condense and mix also with condensed gasoline. These condensed liquids will tend to flow to a low point in the engine; for example, a point in the crankcase chambers 38 or at a point in the lowermost scavenge passages 62. In the illustrated embodiment, the lowest point is in the lowermost scavenge passage 62 of each cylinder. This is partially a result of the horizontal placement of the cylinders, and thus another reason why this invention has particular utility in marine propulsion systems.

A system indicated generally at 85 is provided, in accordance with the invention, for pumping lubricant from this collection area, and this includes a drain pump 86, which may be an electrically operated pump and which is controlled by the ECU 66 in a manner which will be described. This condensed and drained liquid is returned to the engine 22 for burning and eventual discharge to the atmosphere only under certain conditions. This system 85, as noted, includes the pump 86 which draws lubricant from the low point of each of the lowermost scavenge passages 62 through conduits 87 in which check valves 88 are provided. The check valves 88 allow flow to a pump inlet conduit 89, but prevent flow in the opposite direction. The pumped liquid is then returned through return conduits 91 to the intake manifold, and specifically at a point adjacent the throttle valves 42 where the flow velocity will be highest, through a return port in which check valves 92 are provided. The check valves 92 permit flow into the intake passages, but not flow in a reverse direction.

The liquid pumping system 85, and specifically the pump 86, is not operated continuously, but is only operated in response to certain sensed conditions. These may include various factors, but do include sensing when the engine is running at a low speed and the accumulated drains can cause problems in smooth running. When the engine is running at higher speeds and loads, the amount of fuel variation provided by the liquid return is not significant enough to adversely affect engine running.

In view of this, in addition to operating the pump 86 to remove condensed liquids under some conditions, the amount of fuel supplied to the fuel injectors 45 is also varied so as to ensure uniform running.

Figure 5:
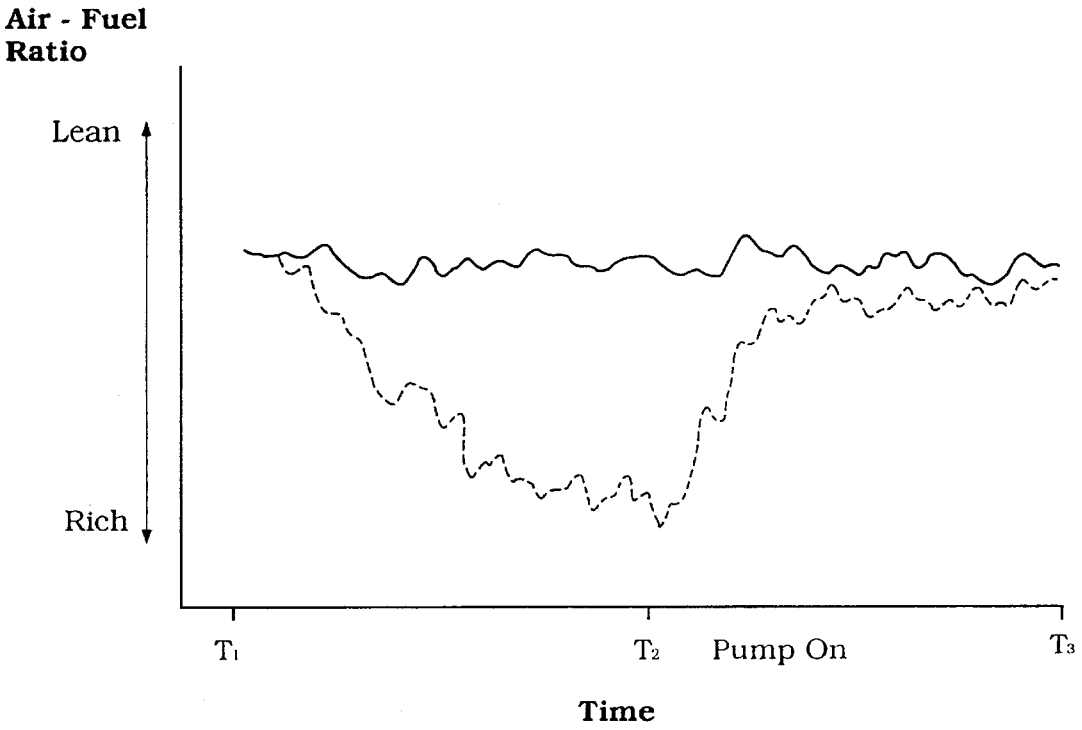
FIG. 5 is a graphical view on the same time scale and shows the instantaneous amount of fuel supplied in total in solid lines and the amount of fuel supplied by the fuel injection device in phantom lines.

FIG. 5 shows the fuel-air ratio, both in broken lines in a condition when the engine is running and the pump 86 is activated. It will be seen that as the time goes on and when the pump runs, the mixture will become gradually richer than desired, and then will return back slowly to a somewhat richer than normal mixture when the accumulated liquids have been depleted sufficiently to return a relatively constant amount of liquid.

In accordance with a feature of the invention, therefore, the amount of fuel supplied to the fuel injectors 45 by the ECU 66 during the time when the pump is running is adjusted. This is done by applying a corrective factor, indicated by the graph in FIG. 4, to the amount of fuel normally which would be supplied for the given running conditions so that the resulting fuel-air ratio will be maintained more constant, as shown by the solid-line view of FIG. 5.

Figure 1:
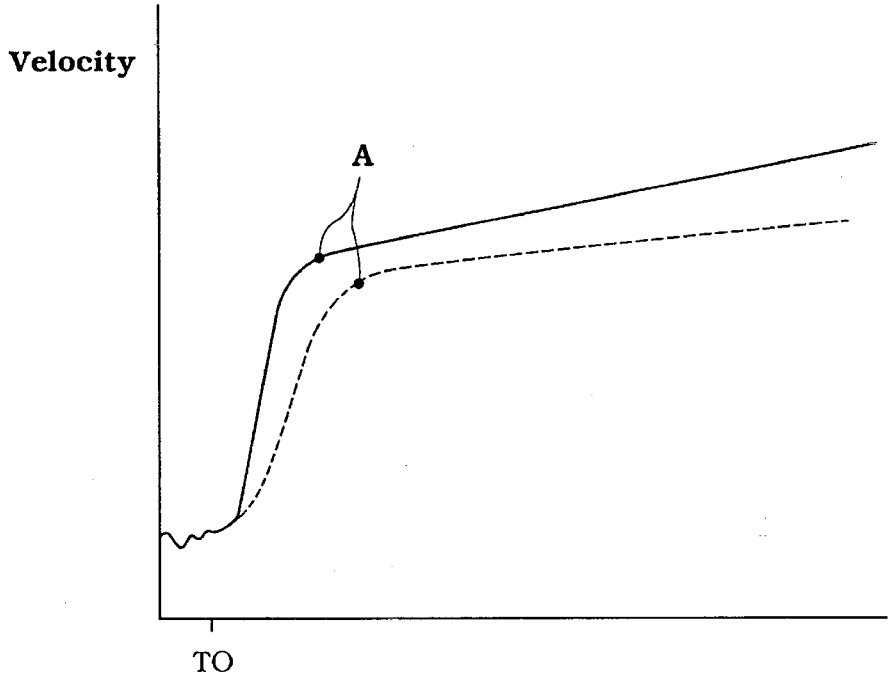
FIG. 1 is a graphical view showing watercraft velocity in relation to time upon acceleration in an engine where there is no drain accumulation and recirculation and an engine where there is drain accumulation and recirculation.
Figure 2:
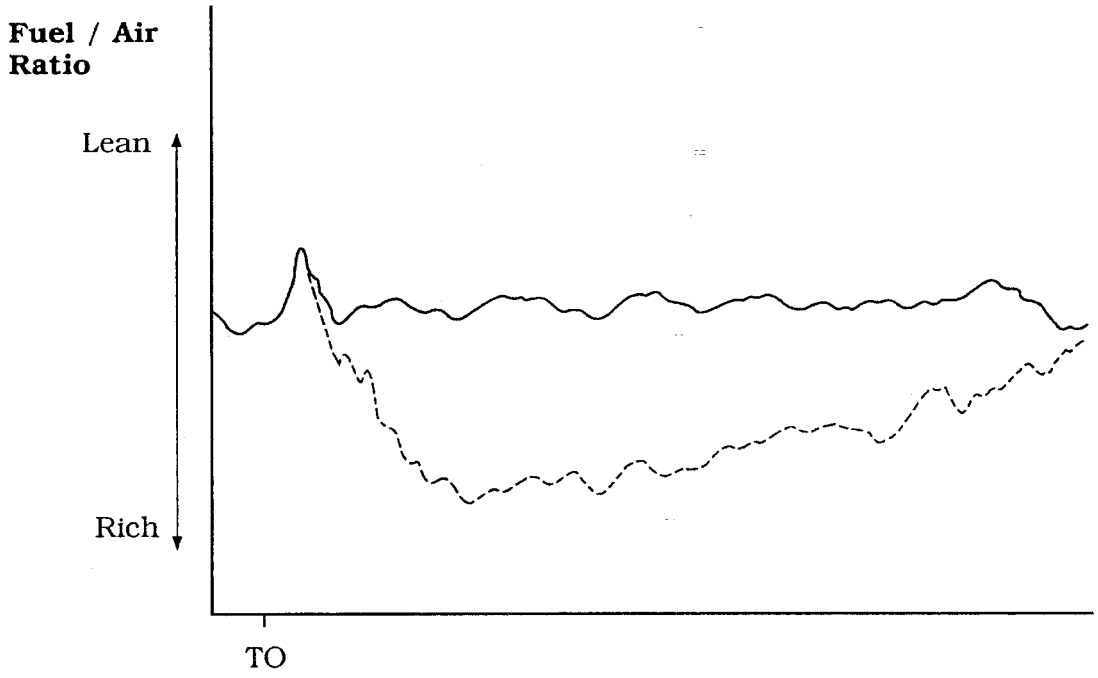
FIG. 2 is a graphical view on the same time scale as FIG. 1 and shows the fuel/air ratio during both types of running.

The basic control routine for the system will now be described by reference to FIG. 6, and also to FIG. 4 which shows the correction factor applied to adjust the amount of fuel injected under this control routine. Basically, the way the system operates in accordance with this embodiment is that if the engine is running and if the throttle valve is below a predetermined condition, indicating low loads, then the fuel injection amount is decreased in an amount dependent upon time; and after that adjustment is made, then the drain pump is run for a predetermined time. The adjustment in injection amount continues during the time when the pump is still running. This, therefore, correlates with the condition shown in the graph of FIG. 2.

Figure 6:
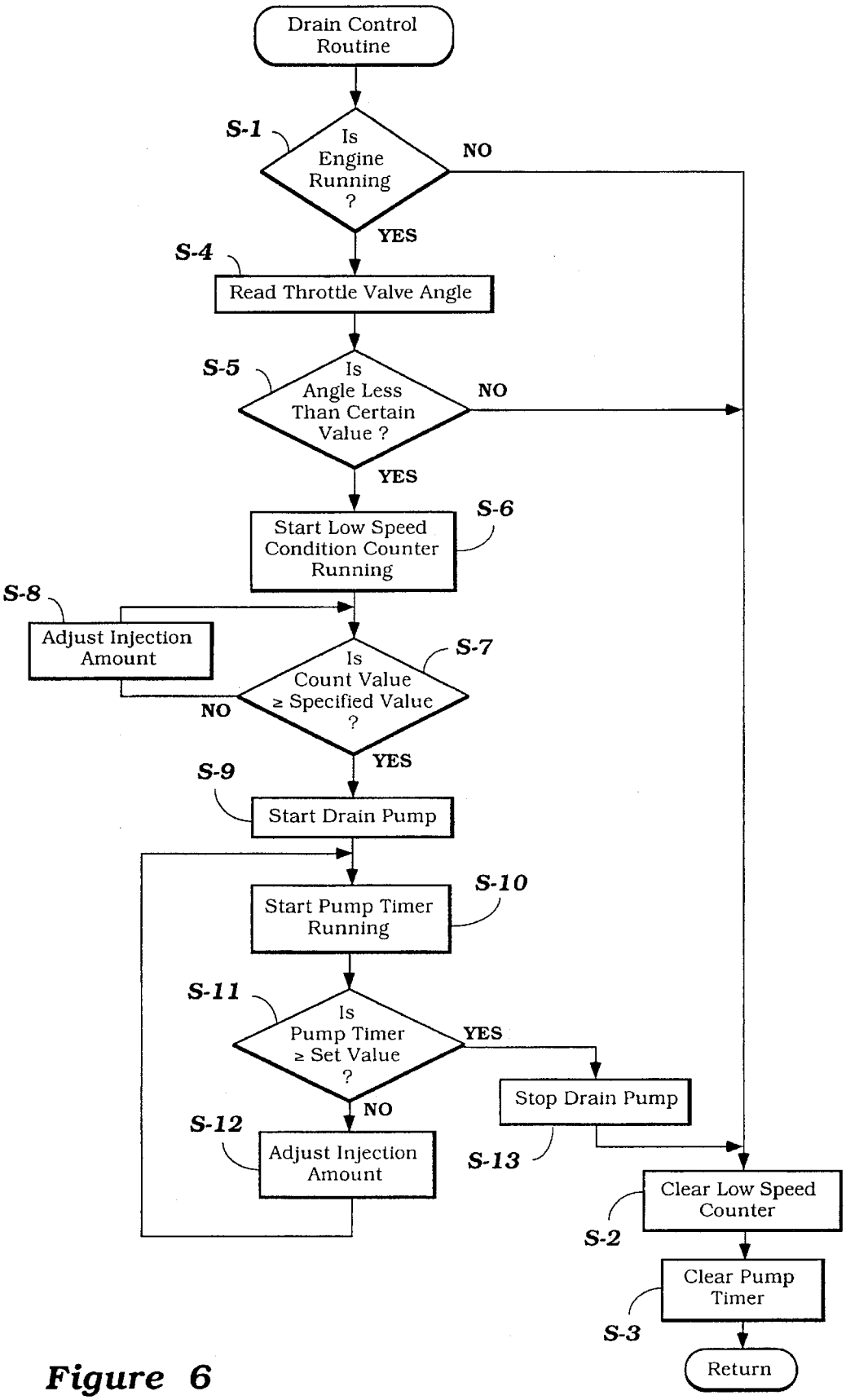
FIG. 6 is a block diagram showing the control routine for operating the pump and altering the fuel amount.

Referring now specifically to FIG. 6, this drain control routine starts at the step S-1 where it is determined initially that the engine 22 is running. If it is not, the program moves to the step S-2 where the low-speed counter of the ECU 66 is reset. The program then moves to the step S-3 so as to clear the pump timer and then returns.

If at the step S-1 it has been determined that the engine is running, the program then moves to the step S-4 so as to read the position of the throttle valve 42. This is done by reading the output of the throttle position sensor 74.

The program then moves to the step S-5 to determine if the angular position of the throttle valve 42 indicates that the engine is running under a low-speed, low-load condition. If it is not, the program goes back to the steps S-2 and S-3 so as to clear the low speed and pump timers and returns.

If, however, the throttle position is below the preset value, the program then moves to the step S-6 so as to start the low-speed counter running. The program then moves to the step S-7 so as to check the value of the low-speed counter and to the step S-8 so as to start correcting the amount of fuel supplied to the fuel injector 45 to begin leaning the fuel-air ratio. This is done by selecting a coefficient value from the map of FIG. 4 wherein the fuel correction factor after the time of starting $T_s$ is selected and then the correction made.

Assuming that sufficient time has elapsed from the start of the low-speed counter so as to start the drain pump operating, the time $T_2$, the program then moves to the step S-9. That is, the amount of fuel injected is decreased before the drain pump actually starts to operate. This is done so as to ensure a smooth transition and to try to maintain the fuel-air ratio as constant as possible, as shown in FIG. 3.

After the step S-9, the program moves to the step S-10 so as to start the pump timer running. In accordance with this embodiment of the invention, the pump 86 of the drain system 85 is run only for a predetermined fixed time interval.

The program, therefore, moves next to the step S-11 so as to determine if the pump timer is such that the pump has run for the predetermined time. If not, the program moves to the step S-12 so as to make a further adjustment in the fuel injection amount, again in accordance with the corrective factor of FIG. 5.

If, however, at the step S-11 it is determined that the time for running of the pump has concluded, the program then moves to the step S-13 so as to stop the operation of the pump 86. The program then moves to the steps S-2 and S-3 so as to clear the low speed and pump timers, respectively.

Figure 7:
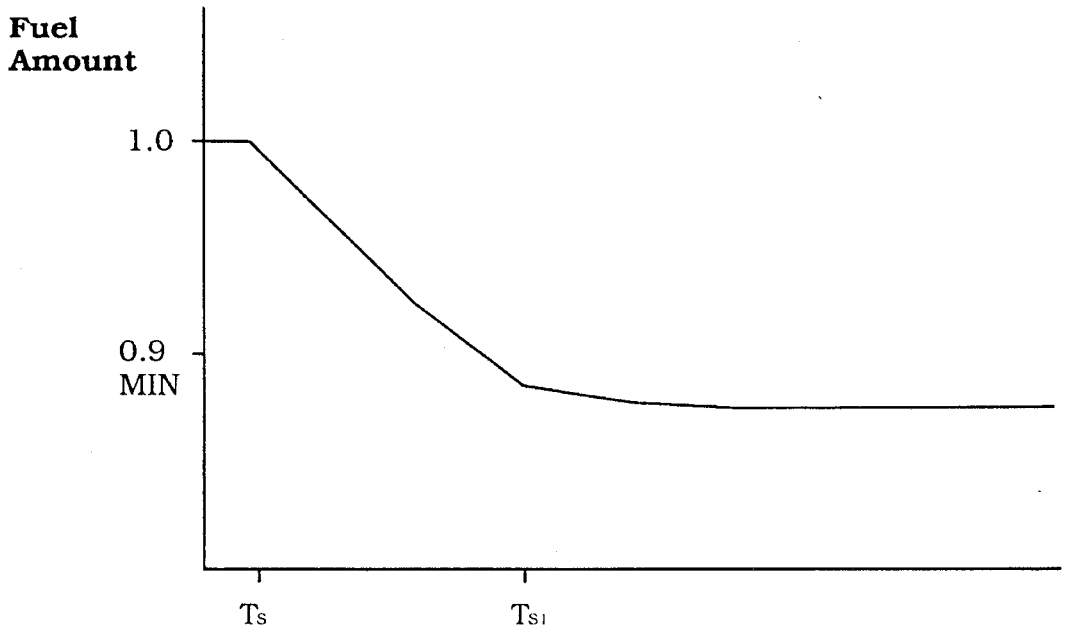
FIG. 7 is a graphical view showing the fuel correction amount in relation to count value elapsed time.

As may be apparent from FIG. 3, the ECU 66, in addition to outputting a pump drive signal to the drain pump 86, receives a pump operating signal back from the pump 86. This pump operating signal is used to determine if the pump 86 is operating properly. This signal may be either a signal indicative of pump speed or pump output pressure or some other indicator of a malfunction in the pump operation. FIGS. 6 and 7 together show the portion control routine, whereby the condition of the pump 86 is monitored and the operation altered if a malfunction is determined. A portion of this control routine, as will be apparent, is the same as FIG. 4.

Once the drain pump abnormality process routine begins, it moves to the step P-1 to determine if the engine is running. If it is not, the program moves to the routine b of FIG. 7, similar to that previously described, where at the step P-2 the low-speed timer is cleared and at the step P-3 where the drain pump running timer is cleared. The program then returns.

If, however, at the step P-1 it is determined that the engine is running, the program moves to the step P-4 to read the throttle valve opening. This is determined, as aforenoted, by sensing the position of the throttle valve 42 by using the throttle valve position sensor 74.

Then, at the step P-5 the program checks to see if the throttle opening is less than a predetermined certain low value. This low value is indication of a low-speed, low-load condition wherein variations in fuel-air ratio can significantly affect the smoothness of the engine running.

Figure 9:
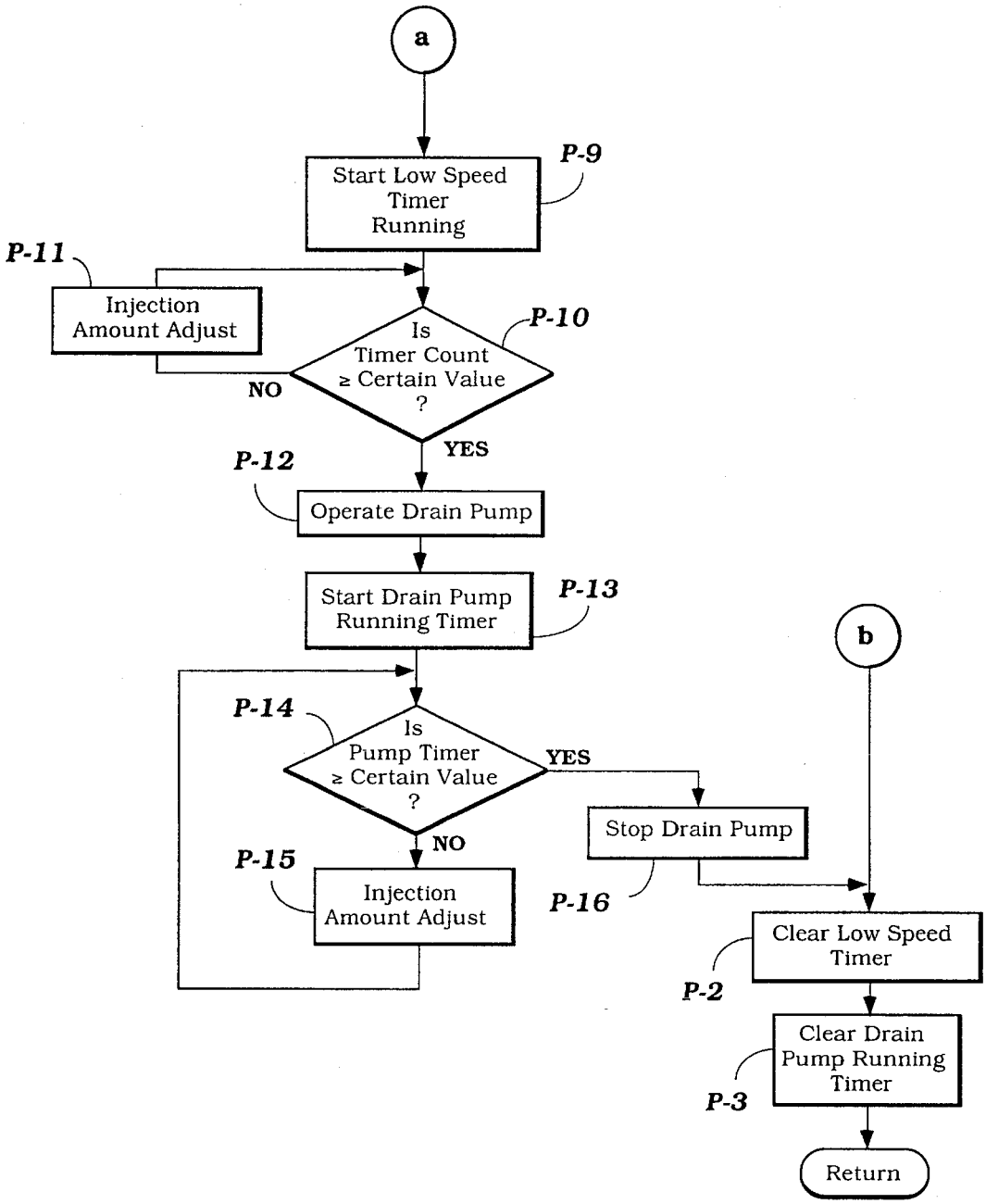
FIG. 9 is a block diagram showing again the fuel injection amount and drain pump operation as a continuation of the control routine of FIG. 8.
Figure 10:
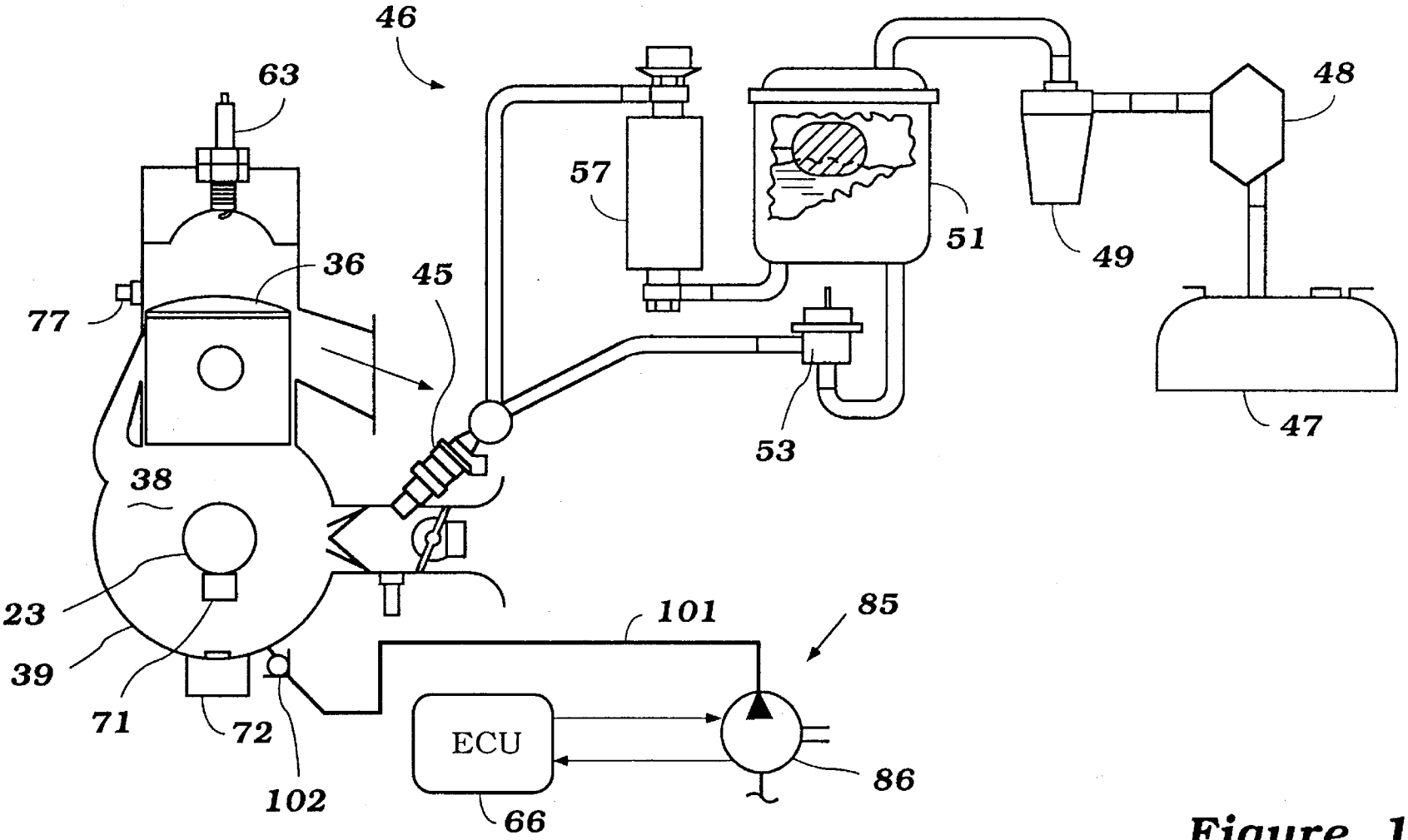
FIG. 10 is a view, in part similar to FIG. 3, and specifically the upper view thereof, and shows another arrangement for returning the pump liquids to the engine induction system.

If at the step P-5 it is determined that the throttle opening is not less than the certain value, the program moves to the routine portion b of FIG. 9. This moves then through the steps P-2 and P-3, wherein the low-speed and drain pump running timers are reset. The program then repeats.

If, however, at the step P-5 it is determined that the throttle is in a position indicative of low-speed or low-load conditions, the program moves to the step P-6 so as to read the operational signal from the pump 86. The program then moves to the step P-7 to determine if the pump operation is abnormal. Assuming the pump has not been running or the running is normal, the former being the case during the initial start-up of the control routine, the program moves to the step P-8 so as to clear the drain pump abnormality counter and then to the control range portion a of FIG. 7.

Figure 4:
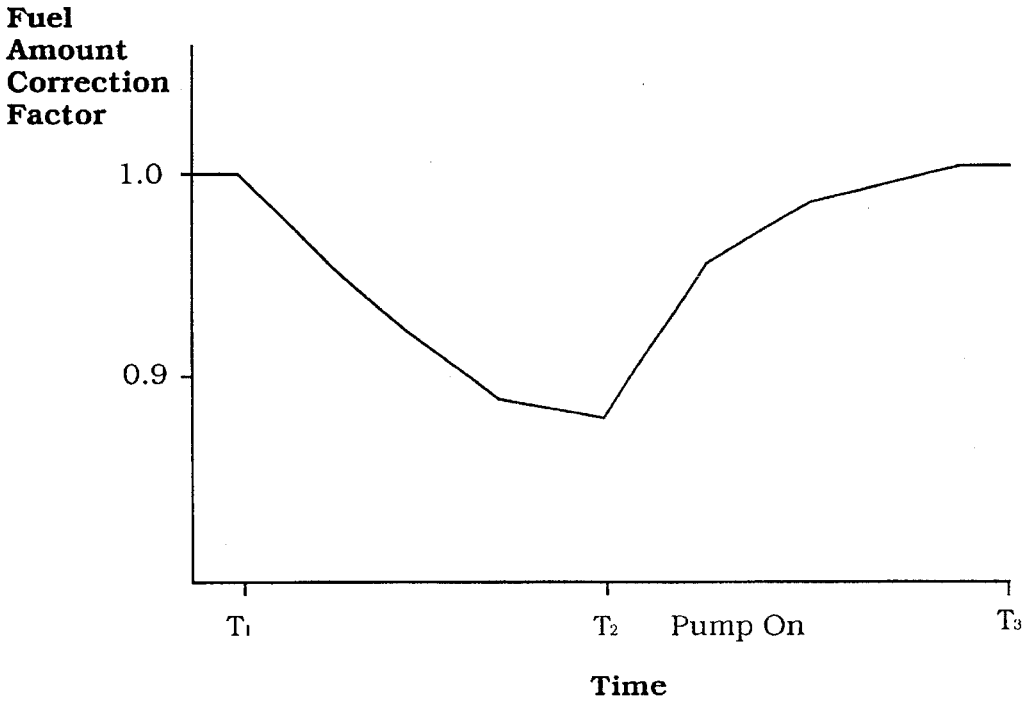
FIG. 4 is a graphical view showing the correction amount made in the fuel supply immediately prior to, during, and after the time when the liquid drain pump is being operated.

Referring now to this control portion, it again is like that of FIG. 4 in that at first, the step P-9 the low-speed timer is started running. The condition of the timer is then sensed at the step P-10, and assuming that the low-speed timer has not reached the certain value, the program moves to the step P-11 so as to correct the fuel supply amount in accordance with the map of FIG. 7, and the program returns.

Once the timer indicates that the fuel ratio has been leaned sufficiently and adequate delay has taken place, the program moves to the step P-12 so as to begin to run the drain pump. The program then moves to the step P-13 so as to start the drain pump running time.

Assuming that the pump is continuing to operate normally, the program then moves to the step P-14 to determine if the pump timer has reached the certain value. If not, the program moves to the step P-15 to again adjust the injection amount in accordance with the graph of FIG. 4.

If, however, at the step P-14 it has been determined that the pump has run for adequate time, the program moves to the step P-16 so as to stop the drain pump. The program then moves back to the steps P-2 and P-3 to reset the low-speed timer and the pump running times.

Figure 8:
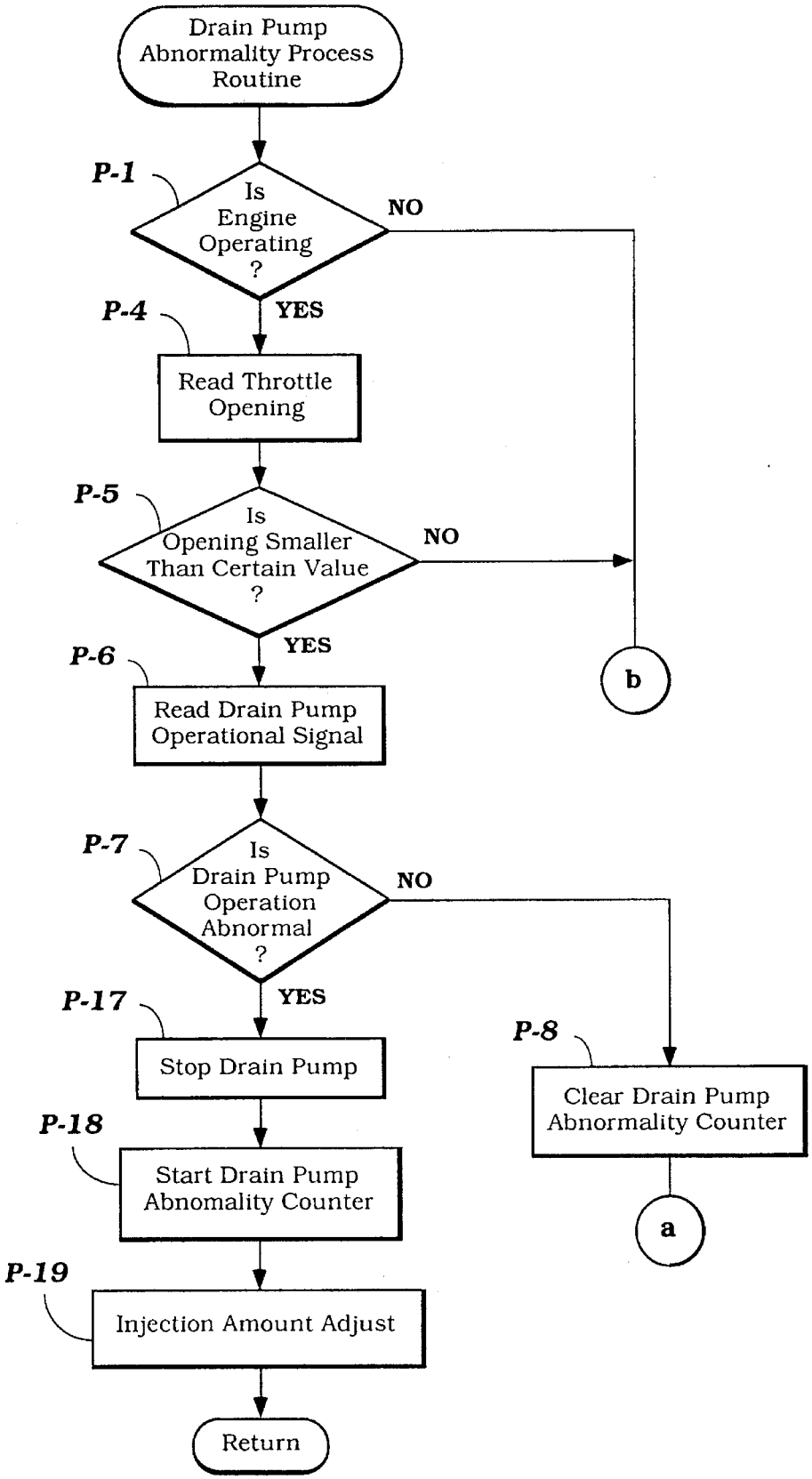
FIG. 8 is a block diagram showing a portion of the control routine for the pumping and fuel control adjustment system and the abnormal pump operation routine.

Referring again to FIG. 8, if at the step P-7 and after the pump has begun running it is determined that the pump is running abnormally, the program is moved to the step P-17. At the step P-17 the drain pump is stopped, and the program then moves to the step P-18 so as to start a drain pump abnormality counter running. The program then moves to the step P-19 so as to adjust the injection amount and begin to return the amount of fuel injection to the normal condition.

In the embodiment of the invention as thus far described, the drained liquids have been returned to the engine directly through the intake manifold for eventual burning. The point at which the liquids may be returned can vary, and FIGS. 10–15 show other embodiments and other return locations. Since the basic structure is the same, only the differences between these embodiments and the earlier ones will be described, and only the different return locations and the components associated with them are illustrated and will be described.

In FIG. 10 the liquids are again returned to the engine induction system, but this time downstream of the check valves 44. Specifically, a return conduit 101 extends from the pump 86 directly to an inlet fitting in the crankcase member 39 in which a one-way check valve 102 is provided. The check valve 102 will open when pressurized by the pump 86 to permit the lubricant and/or fuel that has been pumped to be returned to the crankcase chamber 38. This is done in an area where the air flow will tend to sweep it into the combustion chamber through the scavenge passages 62.

Figure 11:
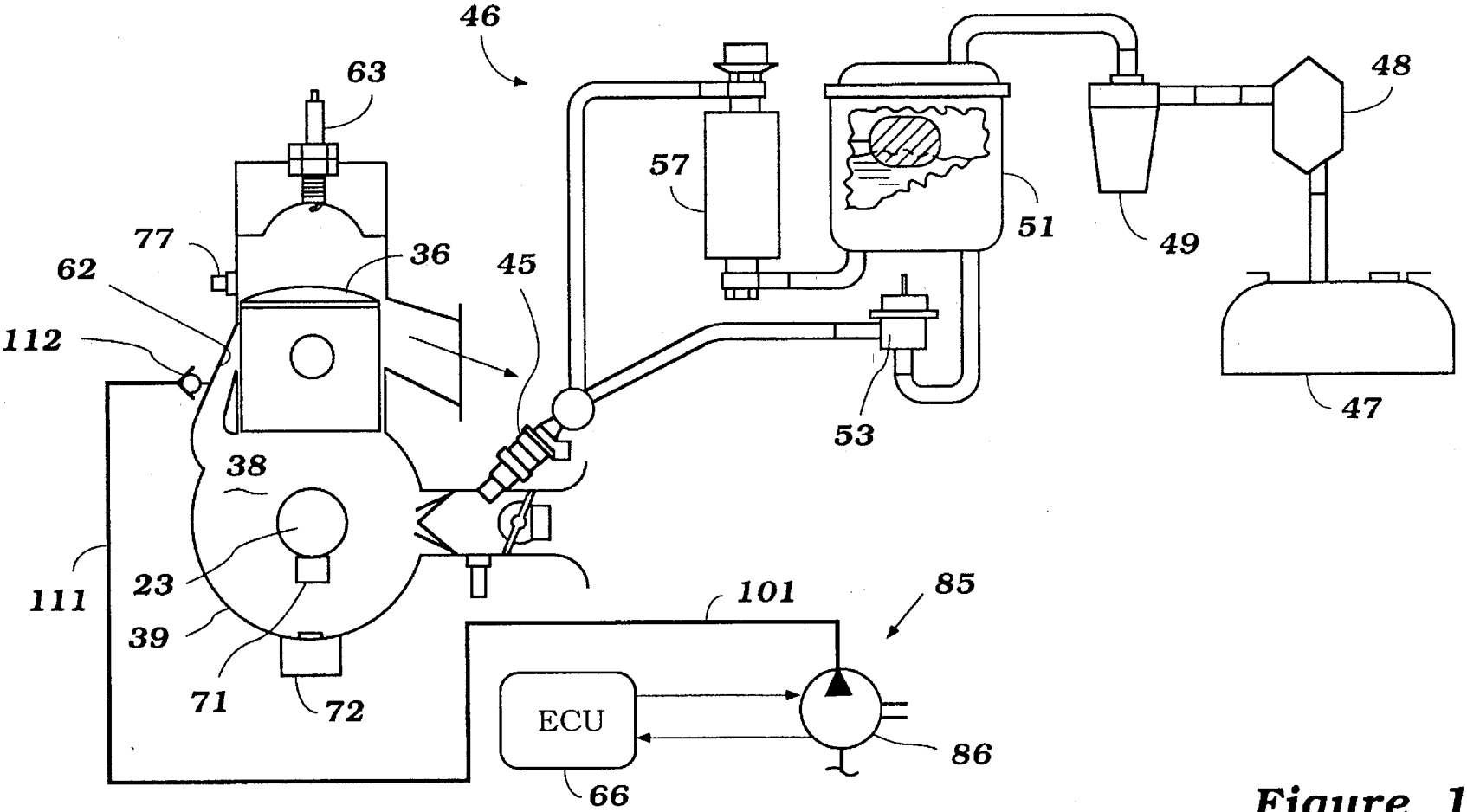
FIG. 11 is a partially schematic view, in part similar to the portion of FIG. 3 and to FIG. 10, and shows another embodiment of the invention.

FIG. 11 shows another embodiment, and in this embodiment the return conduit, indicated generally by the reference numeral 111, extends from the pump 86 to one of the scavenge passages 62. The scavenge passage 62 to which the drains are returned is preferably not the one which is the lowest where the drains tend to accumulate. Again, a pressure responsive check valve 112 permits flow into the scavenge passage 62, but not flow in the reverse direction.

Figure 12:
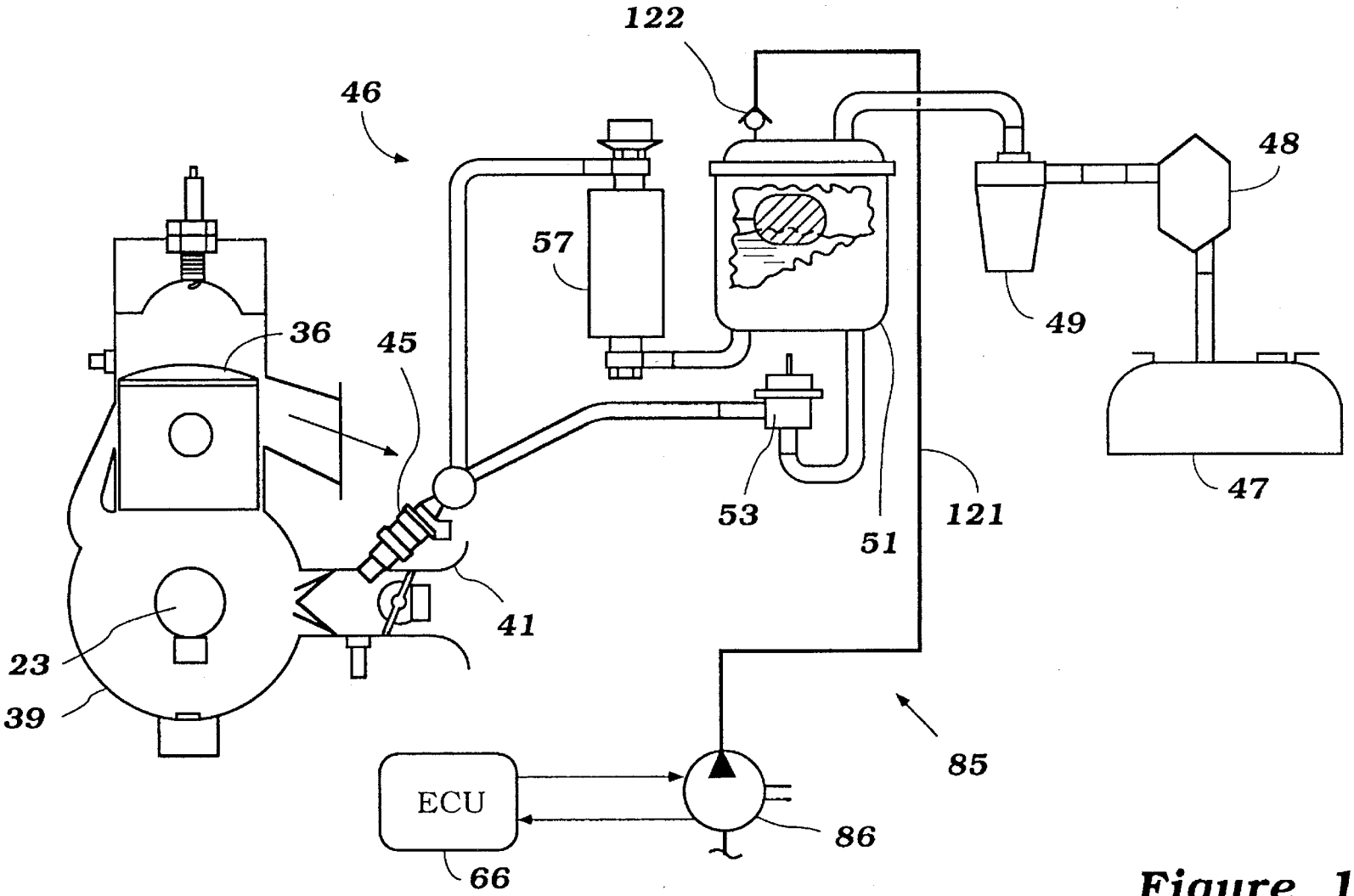
FIG. 12 is a partially schematic view, in part similar to the portion of FIG. 3 and FIGS. 10 and 11, and shows another form of the liquid return.

FIG. 12 shows another embodiment, and in this embodiment the drains are delivered back to the fuel supply side of the system rather than into the induction system side. This will reduce or eliminate the necessity for changing the fuel-air ratio during the time of the drain recirculation. In this embodiment a return conduit 121 extends from the pump 86 into the fuel vapor separator 51 through a one-way check valve 122. The drains are returned above the level of liquid in this particular embodiment.

Figure 13:
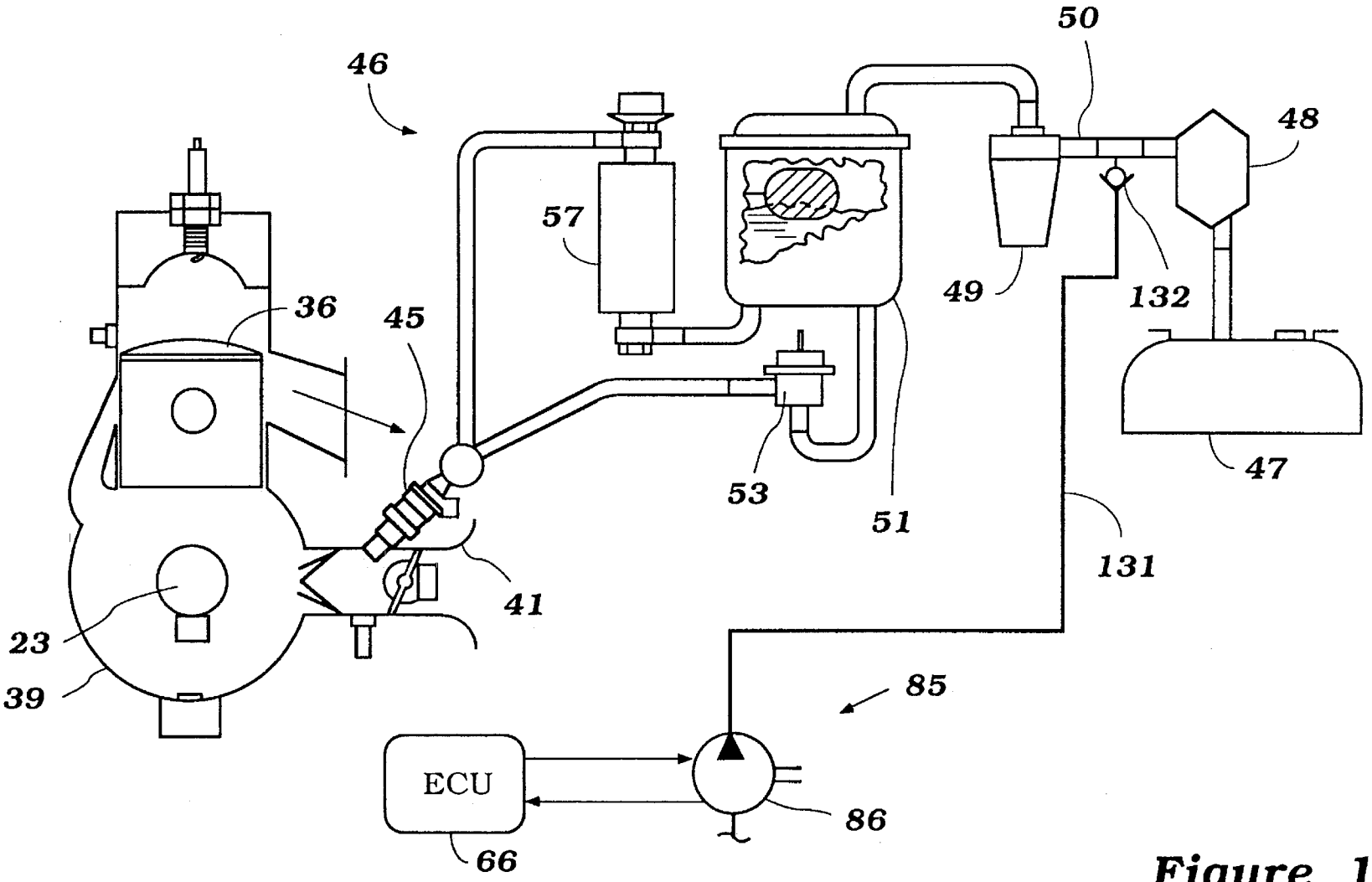
FIG. 13 is a partially schematic view, in part similar to the noted portion of FIG. 3 and FIGS. 10–12, showing a still further embodiment of the invention.

FIG. 13 shows another arrangement wherein a return conduit 131 returns the drains to the conduit 50 that extends between the low-pressure fuel pump 48 and the fuel filter 49. Again, a check valve 132 is provided in the conduit 131 to preclude reverse flow.

Figure 14:
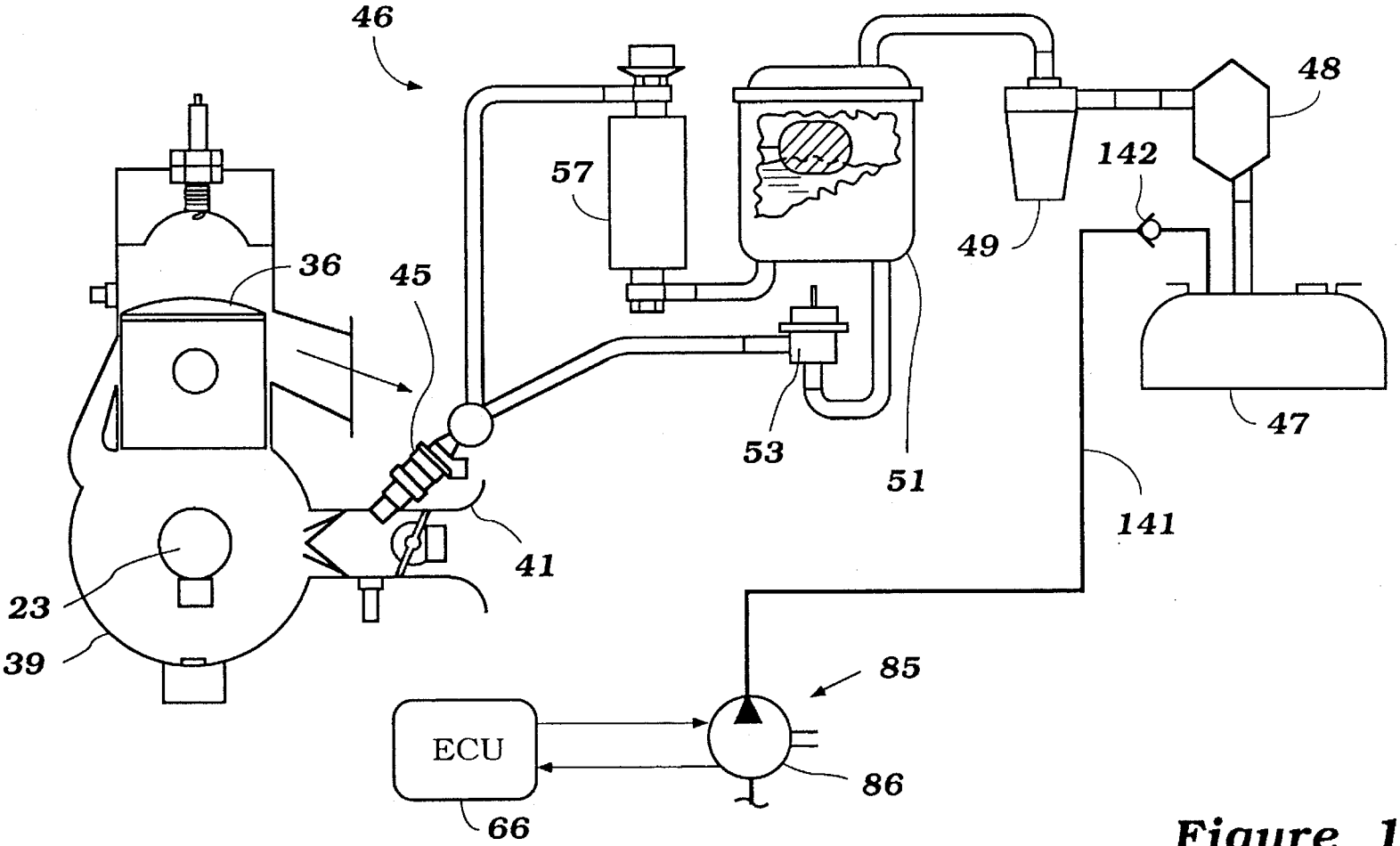
FIG. 14 is a partially schematic view, in part similar to the noted portion of FIG. 3 and FIGS. 10–13, and shows a yet further embodiment of the invention.

FIG. 14 shows another embodiment wherein the drains pumped by the pump 86 are returned directly to the main fuel tank 47 through a conduit 141. Again, a check valve 142 is provided in this conduit so as to reduce the possibility of reverse flow.

Figure 15:
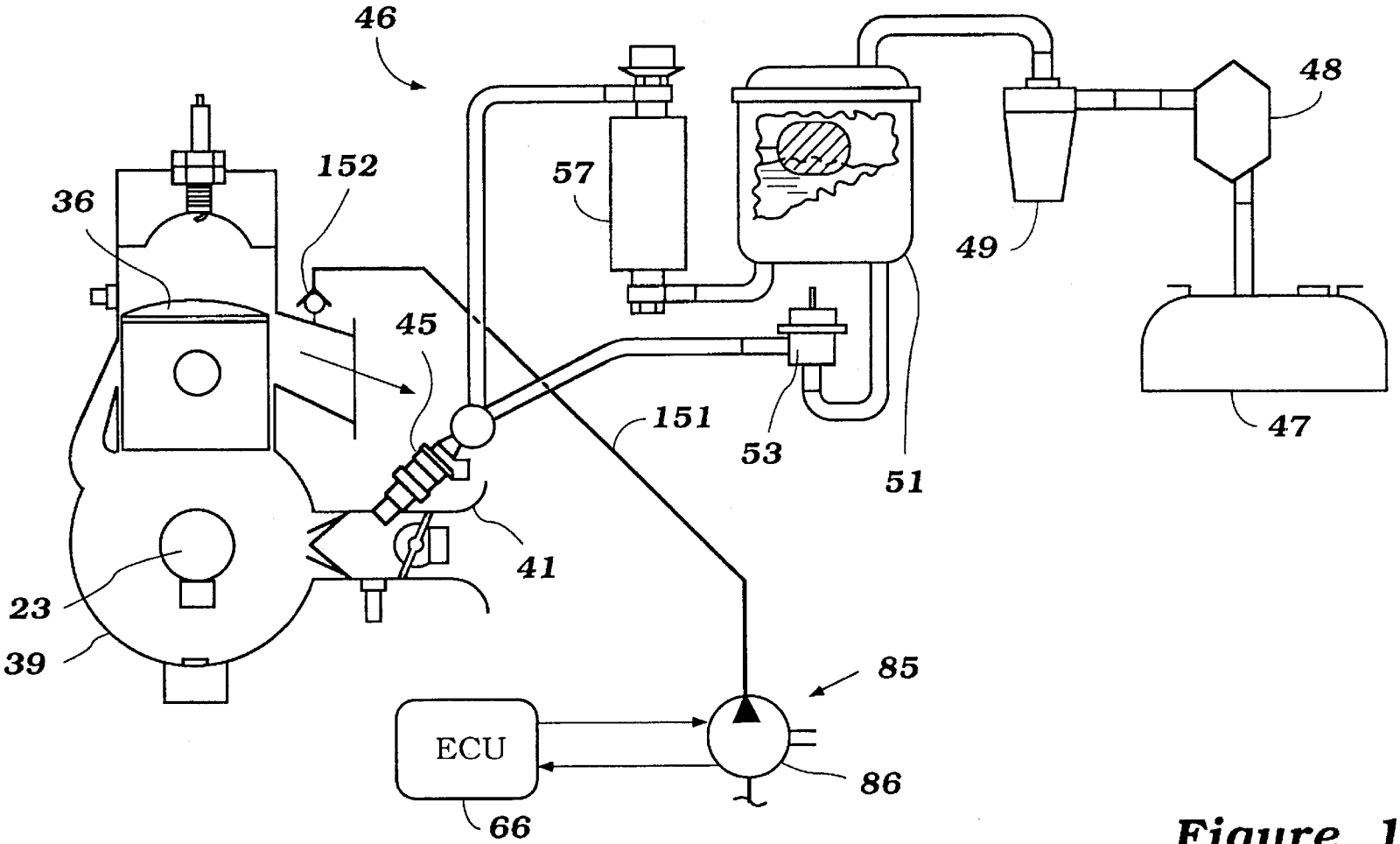
FIG. 15 is a partially schematic view, in part similar to the noted portions of FIGS. 3 and 10–14, and shows another alternative liquid return path.

FIG. 15 shows another embodiment, and in this embodiment a return conduit 151 extends to the exhaust passages 67 of the engine through a check valve 152. By pumping the drains into the exhaust conduit, they will be pumped in an area where the temperature is high enough that the hydrocarbons and harmful constituents will still be at least partially burned, and thus not discharge back to the atmosphere.

Figure 16:
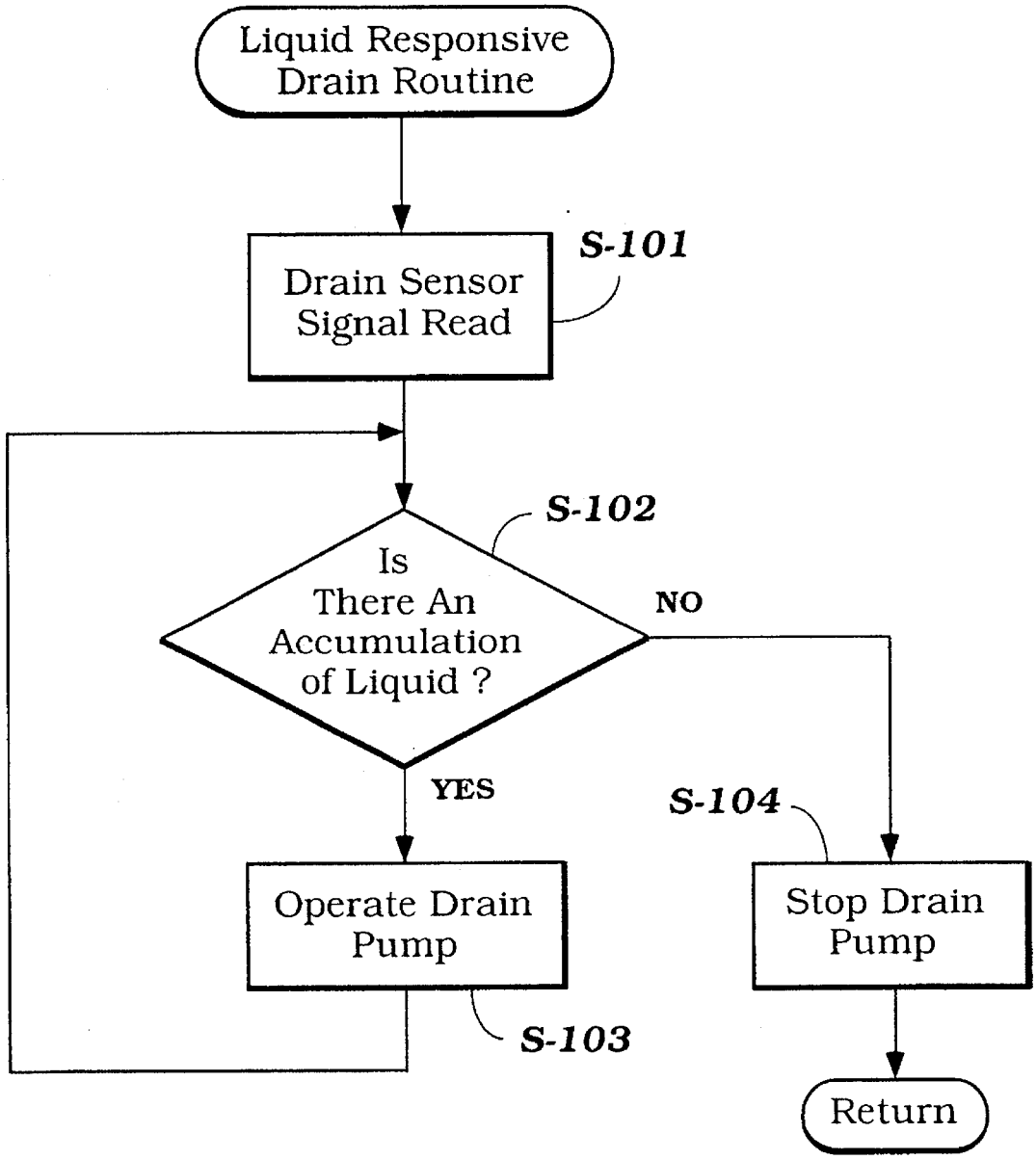
FIG. 16 is a block diagram showing another control routine that may be utilized in conjunction with an arrangement wherein there is liquid level sensor.

In all of the embodiments as thus far described, the drain pumping system 85 has been operated only at low-speed, low-load conditions and only for a predetermined time period. It may be also possible to employ an arrangement wherein a sensor is provided that will sense the accumulation of a predetermined amount of drains in the area where they tend to accumulate. With such an arrangement a sensor may be employed that is responsive to the presence of liquid, and this is used to turn the pump on and off in accordance with a control routine, as shown in FIG. 16.

When this routine starts, the program moves to the step S-101 to read a sensor in the area of drain accumulation. The program then goes to the step S-102 to make a determination as to whether there is an accumulation of liquid or not. As noted, this may be done by a liquid contact sensor or in some other manner.

If there is an accumulation of liquid, the program then moves to the step S-103 so as to operate the drain pump 86. The program then returns back to the step S-102.

If at the step S-102 is determined that the accumulated liquid has been removed or if there was no liquid, the program moves to the step 104 so as to stop the drain pump.

It should be apparent from the foregoing description that the described system is very effective in reducing drain liquid, such as condensed fuel and/or lubricant, under conditions when that fuel could, if delivered to the engine, cause poor running. In addition to returning the drain liquids, the system operates, where necessary, to lean the fuel-air ratio so as to ensure against over-rich running and roughness. Of course, the foregoing description is that of preferred embodiments of the invention, and various changes and modifications may be made without departing from the spirit and scope of the invention as defined by the appended claims.

I claim:

1. A two-cycle crankcase compression internal combustion engine having an induction system for delivering at least an air charge to a combustion chamber of said engine, said engine having an area where fuel and lubricant may accumulate as a fluid during engine operation, pumping means for pumping accumulated fluid from said area, means for sensing a condition, and control means for operating said pumping means only when said condition is sensed.

2. A two-cycle crankcase compression internal combustion engine as set forth in claim 1, wherein the condition is a low speed of the engine.

3. A two-cycle crankcase compression internal combustion engine as set forth in claim 2, wherein the engine induction system includes a throttle valve and the speed is sensed by sensing the position of the throttle valve.

4. A two-cycle crankcase compression internal combustion engine as set forth in claim 3, wherein the control means operate the pumping means for only a predetermined time period after the condition is sensed.

5. A two-cycle crankcase compression internal combustion engine as set forth in claim 1, wherein the fluid pumped by the pumping means is returned to the engine.

6. A two-cycle crankcase compression internal combustion engine as set forth in claim 5, wherein the fluid pumped by the pump is returned to the engine through its induction system.

7. A two-cycle crankcase compression internal combustion engine as set forth in claim 6, wherein the condition is a condition wherein the return of the fluid to the induction system will cause uneven running.

8. A two-cycle crankcase compression internal combustion engine as set forth in claim 7, wherein the engine induction system includes a throttle valve and the speed is sensed by sensing the position of the throttle valve.

9. A two-cycle crankcase compression internal combustion engine as set forth in claim 8, wherein the control means operate the pumping means for only a predetermined time period after the condition is sensed.

10. A two-cycle crankcase compression internal combustion engine as set forth in claim 6, wherein the induction system includes a throttle valve for controlling the speed of the engine and wherein the liquid is returned to the induction system downstream of the throttle valve.

11. A two-cycle crankcase compression internal combustion engine as set forth in claim 10, wherein the fluid is pumped back to the system upstream of a crankcase chamber.

12. A two-cycle crankcase compression internal combustion engine as set forth in claim 10, wherein the liquid is returned to the engine induction system at a crankcase chamber.

13. A two-cycle crankcase compression internal combustion engine as set forth in claim 10, wherein the accumulated fluid is pumped back to a scavenge passage that connects a crankcase chamber with the combustion chamber of the engine.

14. A two-cycle crankcase compression internal combustion engine as set forth in claim 13, wherein the fluid pumped is pumped from a position in the scavenge passage.

15. A two-cycle crankcase compression internal combustion engine as set forth in claim 14, wherein the engine has a plurality of scavenge passages and the fluid is pumped from a low position of one of the scavenge passages and is returned to a high position in another of the scavenge passages for the same combustion chamber.

16. A two-cycle crankcase compression internal combustion engine as set forth in claim 7, wherein the fuel-air ratio supplied by a charge former is adjusted when the fluid is being pumped.

17. A two-cycle crankcase compression internal combustion engine as set forth in claim 16, wherein the adjustment of the charge-forming system is initiated before the pump operation begins.

18. A two-cycle crankcase compression internal combustion engine as set forth in claim 16, wherein the adjustment of the charge-forming system continues after the pump has ceased running.

19. A two-cycle crankcase compression internal combustion engine as set forth in claim 18, wherein the adjustment of the charge-forming system is initiated before the pump operation begins.

20. A two-cycle crankcase compression internal combustion engine as set forth in claim 19, wherein the pump is operated only for a predetermined time period.

21. A two-cycle crankcase compression internal combustion engine as set forth in claim 5, wherein the pumped fluid is returned to the fuel supply system for the engine.

22. A two-cycle crankcase compression internal combustion engine as set forth in claim 21, wherein the fluid pumped is returned to a fuel tank of the engine fuel supply system.

23. A two-cycle crankcase compression internal combustion engine as set forth in claim 21, wherein the fuel supply system includes a vapor separator and the pumped fluid is returned to the vapor separator.

24. A two-cycle crankcase compression internal combustion engine as set forth in claim 5, wherein the pumped fluid is delivered to an exhaust system for the exhaust gases of the engine.

25. A two-cycle crankcase compression internal combustion engine as set forth in claim 24, wherein the pumped fluid is returned to the exhaust system at a point close to an exhaust port that communicates the combustion chamber with the exhaust system.

26. A two-cycle crankcase compression internal combustion engine having an induction and charge-forming system for delivering a fuel-air charge to a combustion chamber of said engine for engine operation, said engine having an area where fuel and lubricant may collect as a fluid, pumping means for pumping the accumulated fluid from said area to said induction and charge-forming system, and means for altering the fuel-air ratio supplied by said charge-forming system in response to the operation of said pumping means.

27. A two-cycle crankcase compression internal combustion engine as set forth in claim 26, wherein the pumping means is operated in response to an engine condition.

28. A two-cycle crankcase compression internal combustion engine as set forth in claim 27, wherein the engine induction system includes a throttle valve and the condition is the position of the throttle valve.

29. A two-cycle crankcase compression internal combustion engine as set forth in claim 28, wherein the control means operate the pumping means for only a predetermined time period after the pumping is initiated.

30. A two-cycle crankcase compression internal combustion engine as set forth in claim 26, wherein the induction system includes a throttle valve for controlling the speed of the engine and wherein the fluid is returned to the induction system downstream of the throttle valve.

31. A two-cycle crankcase compression internal combustion engine as set forth in claim 27, wherein the fluid is pumped back to the system upstream of the crankcase chamber.

32. A two-cycle crankcase compression internal combustion engine as set forth in claim 27, wherein the fluid is returned to the engine induction system at a crankcase chamber.

33. A two-cycle crankcase compression internal combustion engine as set forth in claim 27, wherein the accumulated fluid is pumped back to a scavenge passage that connects a crankcase chamber with the combustion chamber of the engine.

34. A two-cycle crankcase compression internal combustion engine as set forth in claim 33, wherein the fluid pumped is pumped from a position in the scavenge passage.

35. A two-cycle crankcase compression internal combustion engine as set forth in claim 34, wherein the engine has a plurality of scavenge passages and the fluid is pumped from a low position of one of the scavenge passages and is returned to a high position in another of the scavenge passages for the same combustion chamber.

36. A two-cycle crankcase compression internal combustion engine as set forth in claim 26, wherein the adjustment of the charge-forming system is initiated before the pump operation begins.

37. A two-cycle crankcase compression internal combustion engine as set forth in claim 26, wherein the adjustment of the charge-forming system continues after the pump has ceased running.

38. A two-cycle crankcase compression internal combustion engine as set forth in claim 37, wherein the adjustment of the charge-forming system is initiated before the pump operation begins.

39. A two-cycle crankcase compression internal combustion engine as set forth in claim 38, wherein the pump is operated only for a predetermined time period.

40. A method of operating a two-cycle crankcase compression internal combustion engine having an induction system for delivering at least an air charge to a combustion chamber of said engine, said engine having an area where fuel and lubricant may accumulate during engine operation, said method comprising the steps of sensing a condition, and pumping accumulated fluid from said area only when said condition is sensed.

41. A method as set forth in claim 40, wherein the condition is a low speed of the engine.

42. A method as set forth in claim 41, wherein the engine induction system includes a throttle valve and the speed is sensed by sensing the position of the throttle valve.

43. A method as set forth in claim 42, wherein the pumping is done for only a predetermined time period after the condition is sensed.

44. A method as set forth in claim 40, wherein the fluid pumped is returned to the engine.

45. A method as set forth in claim 44, wherein the fluid pumped is returned to the engine through its induction system.

46. A method as set forth in claim 45, wherein the condition is a condition wherein the return of the fluid to the induction system will cause uneven running.

47. A method as set forth in claim 46, wherein the engine induction system includes a throttle valve and the speed is sensed by sensing the position of the throttle valve.

48. A method as set forth in claim 47, wherein the fluid is pumped for only a predetermined time period after the condition is sensed.

49. A method as set forth in claim 45, wherein the induction system includes a throttle valve for controlling the speed of the engine and wherein the fluid is returned to the induction system downstream of the throttle valve.

50. A method as set forth in claim 49, wherein the liquid is pumped back to the system upstream of a crankcase chamber.

51. A method as set forth in claim 49, wherein the fluid is returned to the engine induction system at a crankcase chamber.

52. A method as set forth in claim 49, wherein the accumulated fluid is pumped back to a scavenge passage that connects a crankcase chamber with the combustion chamber of the engine.

53. A method as set forth in claim 52, wherein the fluid pump is pumped from a position in the scavenge passage.

54. A method as set forth in claim 53, wherein the engine has a plurality of scavenge passages and the fluid is pumped from a low position of one of the scavenge passages and is returned to a high position in another of the scavenge passages serving the same combustion chamber.

55. A method as set forth in claim 46, wherein the fuel-air ratio supplied by a charge former is adjusted when the liquid is being pumped.

56. A method as set forth in claim 55, wherein the adjustment of the charge-forming system is initiated before the pump operation begins.

57. A method as set forth in claim 55, wherein the adjustment of the charge-forming system continues after the pumping has ceased running.

58. A method as set forth in claim 57, wherein the adjustment of the charge-forming system is initiated before the pump operation begins.

59. A method as set forth in claim 58, wherein the pumping is done only for a predetermined time period.

60. A method as set forth in claim 44, wherein the pumped fluid is returned to the fuel supply system for the engine.

61. A method as set forth in claim 60, wherein the fluid is returned to a fuel tank of the engine fuel supply system.

62. A method as set forth in claim 60, wherein the fuel supply system includes a vapor separator and the fluid is returned to the vapor separator.

63. A method as set forth in claim 44, wherein the fluid is delivered to an exhaust system for the exhaust gases of the engine.

64. A method as set forth in claim 63, wherein the fluid is returned to the exhaust system at a point close to an exhaust port that communicates the combustion chamber with the exhaust system.

65. A method of operating a two-cycle crankcase compression internal combustion engine having an induction and charge-forming system for delivering a fuel-air charge to a combustion chamber of said engine for engine operation, said engine having an area where fuel and lubricant may collect as a liquid, said method comprising the steps of pumping the accumulated fluid from said area to said induction and charge-forming system, and altering the fuel-air ratio supplied by said charge-forming system in response to the pumping operation.

66. A method as set forth in claim 65, wherein the pumping is done in response to an engine condition.

67. A method as set forth in claim 66, wherein the engine induction system includes a throttle valve and the condition is the position of the throttle valve.

68. A method as set forth in claim 67, wherein the pumping is done only for a predetermined time period after the condition is sensed.

69. A method as set forth in claim 65, wherein the induction system includes a throttle valve for controlling the speed of the engine and wherein the fluid is returned to the induction system downstream of the throttle valve.

70. A method as set forth in claim 66, wherein the fluid is pumped back to the system upstream of the crankcase chamber.

71. A method as set forth in claim 66, wherein the fluid is returned to the engine induction system at the crankcase chamber.

72. A method as set forth in claim 66, wherein the accumulated fluid is pumped back to a scavenge passage that connects a crankcase chamber with the combustion chamber of the engine.

73. A method as set forth in claim 72, wherein the liquid pump is pumped from a position in the scavenge passage.

74. A method as set forth in claim 73, wherein the engine has a plurality of scavenge passages and the fluid is pumped from a low position of one of the scavenge passages and is returned to a high position in another of the scavenge passages.

75. A method as set forth in claim 65, wherein the adjustment of the charge-forming system is initiated before the pumping begins.

76. A method as set forth in claim 65, wherein the adjustment of the charge-forming system continues after the pumping has stopped.

77. A method as set forth in claim 76, wherein the adjustment of the charge-forming system is initiated before the pumping begins.

78. A method as set forth in claim 77, wherein the pumping is done only for a predetermined time period.

* * * * *